US007856860B1

(12) United States Patent
Collison

(10) Patent No.: US 7,856,860 B1
(45) Date of Patent: Dec. 28, 2010

(54) BOTTLE CAP FLATTENER AND METHOD FOR FLATTENING BOTTLE CAPS

(76) Inventor: Catherine A. Collison, 1118 Spruce Ct., Northfield, MN (US) 55057

( * ) Notice: Subject to any disclaimer, the term of this patent is extended or adjusted under 35 U.S.C. 154(b) by 0 days.

(21) Appl. No.: 12/214,440

(22) Filed: Jun. 19, 2008

(51) Int. Cl.
*B21D 51/44* (2006.01)

(52) U.S. Cl. ..... 72/80; 72/358; 72/379.4; 72/404; 412/8

(58) Field of Classification Search ..... 72/80, 72/344, 348, 350, 351, 358, 379.4, 404; 412/8
See application file for complete search history.

(56) References Cited

U.S. PATENT DOCUMENTS 1,840,428 A * 1/1932 Bean et al. ..... 72/358
2,343,006 A * 2/1944 Gibbs ..... 72/353.4
2,349,502 A * 5/1944 Koehler ..... 72/358
2,366,775 A * 1/1945 Essex ..... 72/353.2
4,987,722 A * 1/1991 Koebbeman ..... 72/409.01
5,857,376 A * 1/1999 Bowton et al. ..... 72/379.4
6,386,013 B1 * 5/2002 Werth ..... 72/348

* cited by examiner

*Primary Examiner*—David B Jones
(74) *Attorney, Agent, or Firm*—Antonio Papageorgiou; Ostrow Kaufman LLP

(57) ABSTRACT

The present invention in one embodiment is a device and method for flattening bottle caps from beverage containers. In a preferred embodiment of the invention, the bottle cap flattener includes a bottle cap positioner, a bottle cap holder, a bottle cap flattening tool, a motor and a positioning jig. The bottle cap positioner precisely locates a bottle cap so that the bottle cap flattening tool can interact with the bottle cap to flatten the bottle cap. The bottle cap positioner preferably includes a rotatable disk that is rotated by the motor. The bottle cap flattening tool applies pressure to a bottle cap through a tip to force the outer portion of the bottle cap into a flattened configuration along with the central portion of the bottle cap. The bottle cap holder applies force to a bottle cap located on the bottle cap positioner to hold the bottle cap in a precise relationship with the bottle cap positioner. Where the bottle cap positioner includes a rotating disk, the bottle cap holder applies force to a bottle cap located on the disk to hold the bottle cap on the disk. The positioning jig precisely locates the bottle cap on the friction surface of the disk so that the bottle cap can be acted on by the bottle cap flattening tool.

27 Claims, 7 Drawing Sheets

BOTTLE CAP FLATTENER AND METHOD FOR FLATTENING BOTTLE CAPS

BACKGROUND OF THE INVENTION

1. Field of the Invention

The present invention is directed to a device and method for flattening bottle caps as a precursor for making decorative objects out of the flattened bottle cap.

2. Description of Related Art

Many people enjoy making and displaying new and interesting ornaments out of bottle caps such as beads, buttons, brooches, hanging ornament, baubles, pennants, knick-knacks, curios, novelty items, ornaments, trinkets, figurines, objet d'art, souvenirs or other small objects displayed for their attractiveness or interest. Typically, these bottle caps come from beverage bottles where the bottle caps seal the bottles. Often, these bottle caps are very decorative and display interesting logos, colors, patterns or trademarks. Typically, once a bottle cap is removed from a bottle, the bottle cap is simply discarded. The bottle cap then becomes waste that is ultimately disposed of. Consequently, it is highly desirable to provide flattened bottle caps that can then be used to produce interesting and visually attractive ornamental objects or pieces of jewelry and in addition, reduce waste.

SUMMARY OF THE INVENTION

The present invention in one embodiment is a device and method for flattening bottle caps from beverage containers. In a preferred embodiment of the invention, the bottle cap flattener includes a bottle cap positioner, a bottle cap holder, a bottle cap flattening tool, a motor and a positioning jig. The bottle cap positioner precisely locates a bottle cap so that the bottle cap flattening tool can interact with the bottle cap to flatten the bottle cap. The bottle cap positioner preferably includes a rotatable disk that is rotated by the motor. The bottle cap flattening tool applies pressure to a bottle cap through a tip to force the outer portion of the bottle cap into a flattened configuration along with the central portion of the bottle cap. The bottle cap holder applies force to a bottle cap located on the bottle cap positioner to hold the bottle cap in a precise relationship with the bottle cap positioner. Where the bottle cap positioner includes a rotating disk, the bottle cap holder applies force to a bottle cap located on the disk to hold the bottle cap on the disk. The positioning jig precisely locates the bottle cap on the friction surface of the disk so that the bottle cap can be acted on by the bottle cap flattening tool.

Once a bottle cap is flattened, the flattened bottle cap or portions of the flattened bottle cap is used to make pieces of jewelry or other ornamental objects.

There are many objects of the present invention in its various embodiments that may be addressed individually or in combinations and permutations. Each embodiment may address one or several of the following objectives.

An object of this invention in one embodiment or variant of the invention is to produce a device for flattening bottle caps.

Another object of this invention in one embodiment or variant of the invention is to produce a device for flattening bottle caps that is easy to use.

Another object of this invention in one embodiment or variant of the invention is to produce a device for flattening bottle caps that does not tear the material of the bottle cap.

Another object of this invention in one embodiment or variant of the invention is to provide flattened bottle caps that can then be used to produce interesting and visually attractive ornamental objects or pieces of jewelry.

Another object of this invention in one embodiment or variant of the invention is to reduce the amount of waste produced by throwing away bottle caps.

These and other objects and advantages of the invention will be clear in view of the following description to the invention including the associated drawings.

BRIEF DESCRIPTION OF THE DRAWINGS

The invention will be described hereafter in detail with particular reference to the drawings. Throughout this description, like elements, in whatever embodiment described, refer to common elements wherever referred to and referenced by the same reference number. The characteristics, attributes, functions, interrelations ascribed to a particular element in one location apply to that element when referred to by the same reference number in another location unless specifically stated otherwise. All Figures are drawn for ease of explanation of the basic teachings of the present invention only; the extensions of the Figures with respect to number, position, relationship, and dimensions of the parts to form the preferred embodiment will be explained or will be within the skill of the art after the following description has been read and understood. Further, the exact dimensions and dimensional proportions to conform to specific force, weight, strength and similar requirements will likewise be within the skill of the art after the following description has been read and understood.

DETAILED DESCRIPTION OF THE INVENTION

Figure 1:
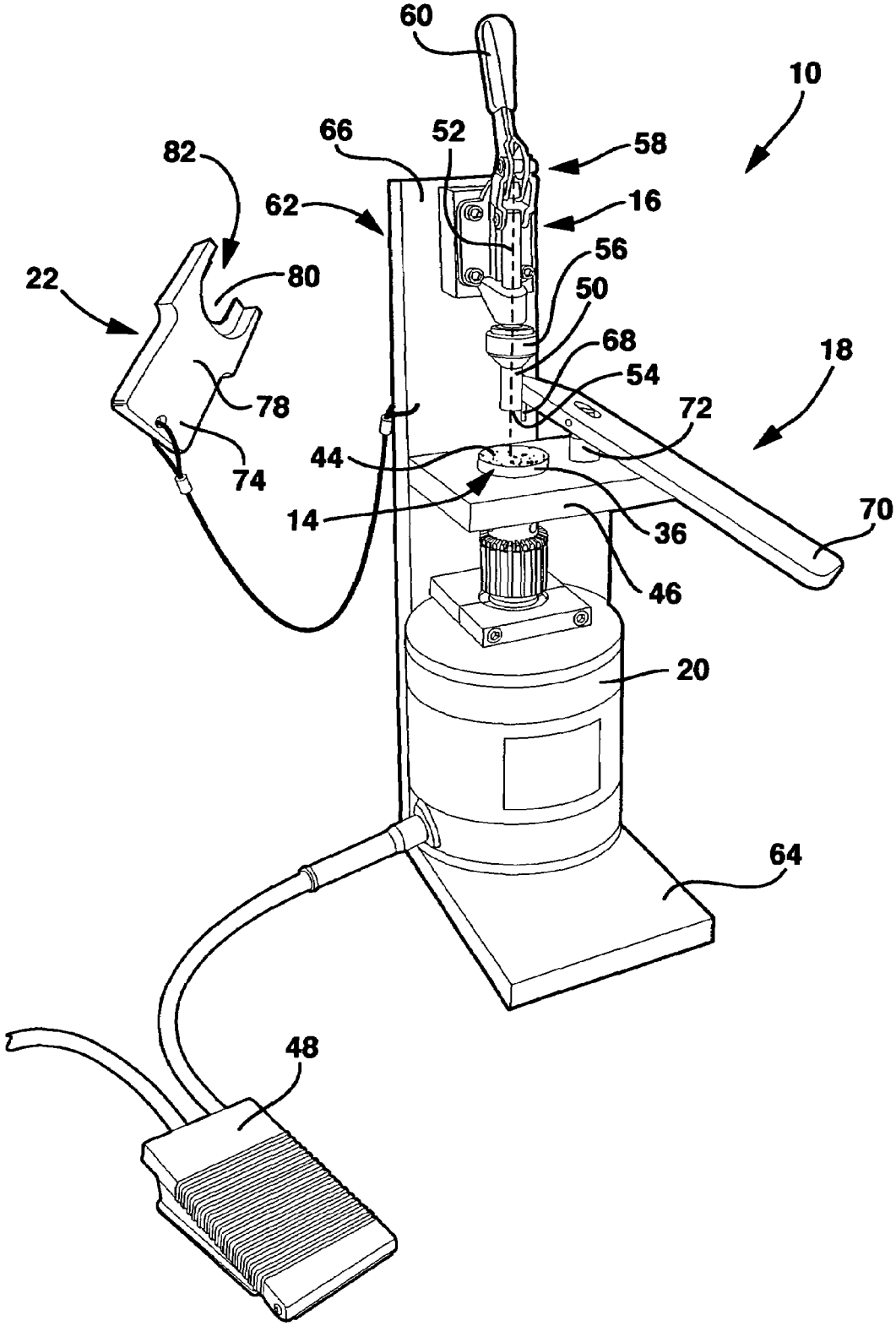
FIG. 1 is a perspective view of the bottle cap flattener of one embodiment of the invention.

A bottle cap flattener of the present invention in one embodiment is shown in FIGS. 1 and 3-7 generally labeled 10. The bottle cap flattener 10 is intended to flatten a bottle cap 12. The bottle cap flattener 10, in a preferred embodiment, includes a bottle cap positioner 14, a bottle cap holder 16, a bottle cap flattening tool 18, a motor 20 and a positioning jig 22.

Figure 2:
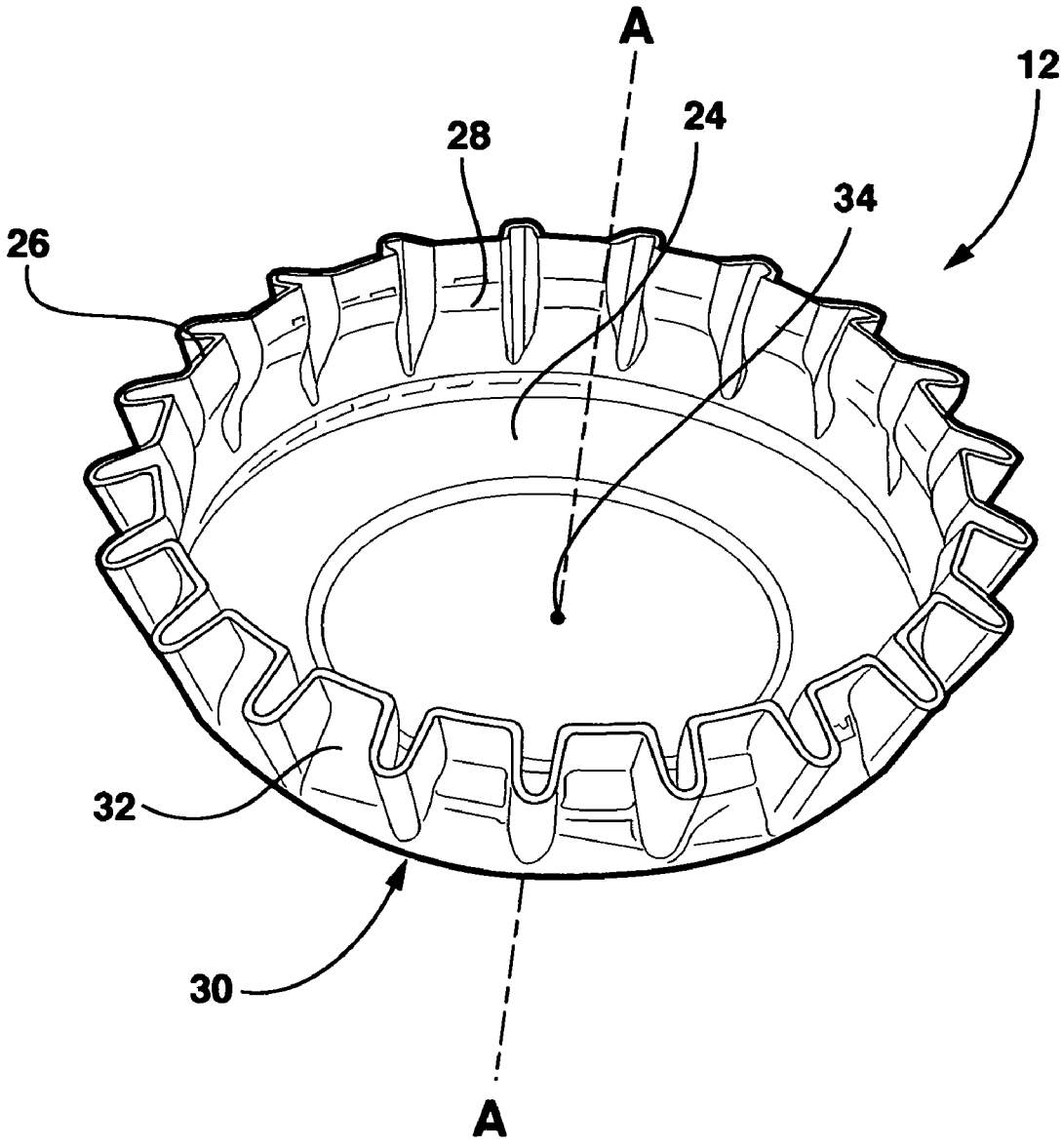
FIG. 2 is a perspective view of a bottle cap that is flattened by the invention of FIG. 1.

For reference, as shown in FIG. 2, each bottle cap 12 has a central portion 24, a peripheral edge 26, an inner surface 28, a shoulder 30, an outer portion 32 connecting the shoulder 30 to the peripheral edge 26 and a center 34 located at the center of the central portion 24 of the bottle cap 12. An axis "A: extends through the center 34 essentially perpendicular to the plane of the central portion 24. The outer portion 32 is typically crenellated, that is, formed in a repeating series of undulations, which crenellations were formed as part of the process of sealing the bottle cap 12 on the beverage container. The central portion 24 is the flat portion of the bottle cap 12 that often contains a trademark or other written or printed indicia on its outer surface.

The function of the bottle cap positioner 14 is to precisely locate a bottle cap 12 so that the bottle cap flattening tool 18 can interact with the bottle cap 12 to flatten the bottle cap 12 as will be described hereafter. The bottle cap positioner 14 preferably includes a rotatable disk 36. The disk 36 is a flat disk that has an upper surface 38 and an axis 40 and is able to spin around its axis 40 on a bearing 42. The disk 36 preferably has a diameter slightly larger than the diameter of a bottle cap 12 after it is flattened as will be described hereafter.

The disk 36 is preferably oriented so that the upper surface 38 faces upwards. The upper surface 36 of the disk 36 preferably inherently has a friction surface 44 that holds the bottle cap on a desired location on the disk 36 as will be described hereafter. For example, the disk 36 may itself be made of a material that inherently has a high friction surface or the disk 36 may be modified by scratching, etching or molding the upper surface 38 to form a friction surface 44.

Although the disk 36 preferably itself has a friction surface 44, this friction surface 44 optionally may be a rubberized or similar coating that prevents a bottle cap 12 placed on the disk 36 from moving around on the disk 36. This type of friction surface 44 may be either a disk of material such as a rubberized material that is attached to the disk 36 by, for example, adhesives, or may be a material that is applied to the disk 36 in liquefied form and that hardens into the friction surface 44.

The disk 36 is preferably positioned by a positioning member 46 that locates and supports the disk 36 and is attached to the disk 36 through a bearing 42 that allows the disk 36 to freely rotate around its axis 40. The motor 20 is attached to the disk 36 so that the motor 20 causes the disk 36 to rotate around its axis 40. The motor 20 is preferably an electric motor that is powered by typical commercially available electric power. However, the motor 20 may be a common electric drill that is connected to the disk 36 through a standard chuck or any device capable of imparting rotational movement to the disk 36 so that the disk 36 rotates around its axis 40. Also, the motor 20 is preferably controlled by a switch 48 such as a footswitch that turns the motor 20 on or off as desired by the user of the bottle cap flattener 10.

The function of the bottle cap holder 16 is to apply force to a bottle cap 12 located on the bottle cap positioner 14 to hold the bottle cap 12 in a precise relationship with the bottle cap positioner 14. Where the bottle cap positioner 14 includes a disk 36, the bottle cap holder 16 applies force to a bottle cap 12 located on the disk 36 to hold the bottle cap 12 on the disk 36. A typical bottle cap holder 16 includes an elongated pin 50 having a pin axis 52 and a terminal end 54. The pin 50 moves longitudinally along its pin axis 52 so that the terminal end 54 moves into and out of contact with the inner surface 28 of a bottle cap 12 placed on the disk 36 as will be described hereafter. In a preferred embodiment of the bottle cap holder 16, the pin 50 moves through a positioning bearing 56 that allows the pin 50 to move only longitudinally through the positioning bearing 56. A pivot press 58 applies force to the pin 50 to move the pin 50 longitudinally along the pin's pin axis 52. The pivot press 58 is preferably a linear actuator, as is well known in the art, that includes a handle 60. Moving the handle 60 in a first direction moves the terminal end 54 of the pin 50 longitudinally into contact with the inner surface 28 a bottle cap 12 located on a disk 36 and moving the handle 60 in a second opposite direction moves the terminal end 54 of the pin 50 out of contact with the inner surface 28 of the bottle cap 12 located on a disk 36.

It is desired that the terminal end 54 apply enough pressure to the bottle cap 12 to hold the bottle cap 12 in a desired configuration on the frictional surface 24 of the disk 36 but not so much pressure as to deform the bottle cap 12 or to put so much pressure on the bearing 42 as to damage the bearing 42 or prevent the bearing 42 from freely turning and thereby preventing the disk from freely turning.

Also, it is preferable but not required that the terminal end 54 be roughly semi-circular so that only a portion of the cross-section of the pin 50 actually contacts the bottle cap 12 on the disk 36. Although not required to be roughly semi-circular, it has been found that this configuration is particularly helpful in holding the bottle cap 12 on the disk 36 while forces are applied by the a bottle cap flattening tool 18 that tend to try to move the bottle cap 12 out of the desired configuration on the disk 36.

The pivot press 58 has been described as being a hand actuated linear actuator device that moves the terminal end 54 of the pin 50 in a longitudinal direction. But, any device that moves the terminal end 54 of the pin 50 in a linear direction into and out of contact with an inner surface 28 of a bottle cap 12 located on the disk 36 may be used as will be well known to those skilled in the art.

In a preferred embodiment of the bottle cap flattener 10, the pivot press 58 and positioning member 46 are attached to a support 62. In one embodiment of the bottle cap flattener 10, the support 62 is a single elongated L-shaped piece having a bottom portion 64 and an upper portion 66. In this embodiment of the support 62, the bottom portion 64 rests on a bench or table and supports the motor 20 and the upper portion 66 supports the pivot press 58 and positioning member 46.

As mentioned above, the bottle cap flattener 10 also includes a bottle cap flattening tool 18. The function of the bottle cap flattening tool 18 is to apply pressure to a bottle cap 12 to force the outer portion 32 of the bottle cap 12 into a flattened configuration along with the central portion 24 of the bottle cap 12. The bottle cap flattening tool 18 has a tip 68 that contacts the bottle cap 12 to flatten the bottle cap 12 as will be described hereafter. In a preferred embodiment of the bottle cap flattener 10, the bottle cap flattening tool 18 is an elongated member that includes a handle 70 and is attached to the positioning member 46 through a pivot 72 so that movement of the handle 70 moves the tip 68 into and out of contact with the bottle cap 12 on the disk 36 from a location at the center 34 of the bottle cap 12 to the peripheral edge 26 of the bottle cap 12. The pivot 72 is preferably attached to the positioning member 46 so that the tip 68 of the bottle cap flattening tool 18 can be moved into contact with the bottle cap 12 as described above.

The preferred embodiment of the bottle cap flattening tool 18 is an elongated member having a handle 70 that allows the user to manipulate the bottle cap flattening tool 18 by manipulating the handle 70. Such a bottle cap flattening tool 18 allows a user to have a large amount of individual manual control over the interaction between the tip 68 and the bottle cap 12 during the flattening process that will be described hereafter. But, the bottle cap flattening tool 18 may be any device, as will occur to those skilled in the art, that moves the tip 68 into and out of contact with a bottle cap 12 at a desired location from the center 34 of the bottle cap 12 to the peripheral edge 26 of the bottle cap 12. For example, the tip 68 may be attached to a linear actuator that moves the tip vertically into and out of contact with the bottle cap 12 on the disk 36 and at the same time to another actuator that moves the tip 68 from the center 34 of the bottle cap 12 to the peripheral edge 26 of the bottle cap 12. Such a device may be manually controlled or controlled by a control system such as a programmable computer, application specific integrated circuit (ASIC), analog electronic circuitry or a mechanical control as will be clear to those skilled in the art.

The bottle cap flattener 10 also preferably includes a positioning jig 22. The function of the positioning jig 22 is to precisely locate the bottle cap 12 on the friction surface 24 of the disk 36. In the preferred embodiment of the positioning jig 22, the positioning jig 22 has a handle 74, a top side 76, a bottom side 78, a central chamber 80 and an opening 82. The handle 74 allows the user to manipulate and place the positioning jig 22 on the disk 36 as will be described hereafter.

The central chamber 80 extends upward from the bottom side 78 toward the top side 76 and has a width that is about equal to the diameter of the disk 36 so that the central chamber 80 may slide over the disk 36. The opening 82 of the positioning jig 22 extends upward from the central chamber 80 through the top side 76. The opening 82 has a curved back end 84 and an open end 86. The back end 84 has a curvature approximately equal to curvature of the peripheral edge 26 of the outer portion 32 of a bottle cap 12 and the opening 82 has a width "A" about equal to the diameter of an outer portion 32 of a typical bottle cap 12 that has been removed from a beverage bottle.

Figure 6:
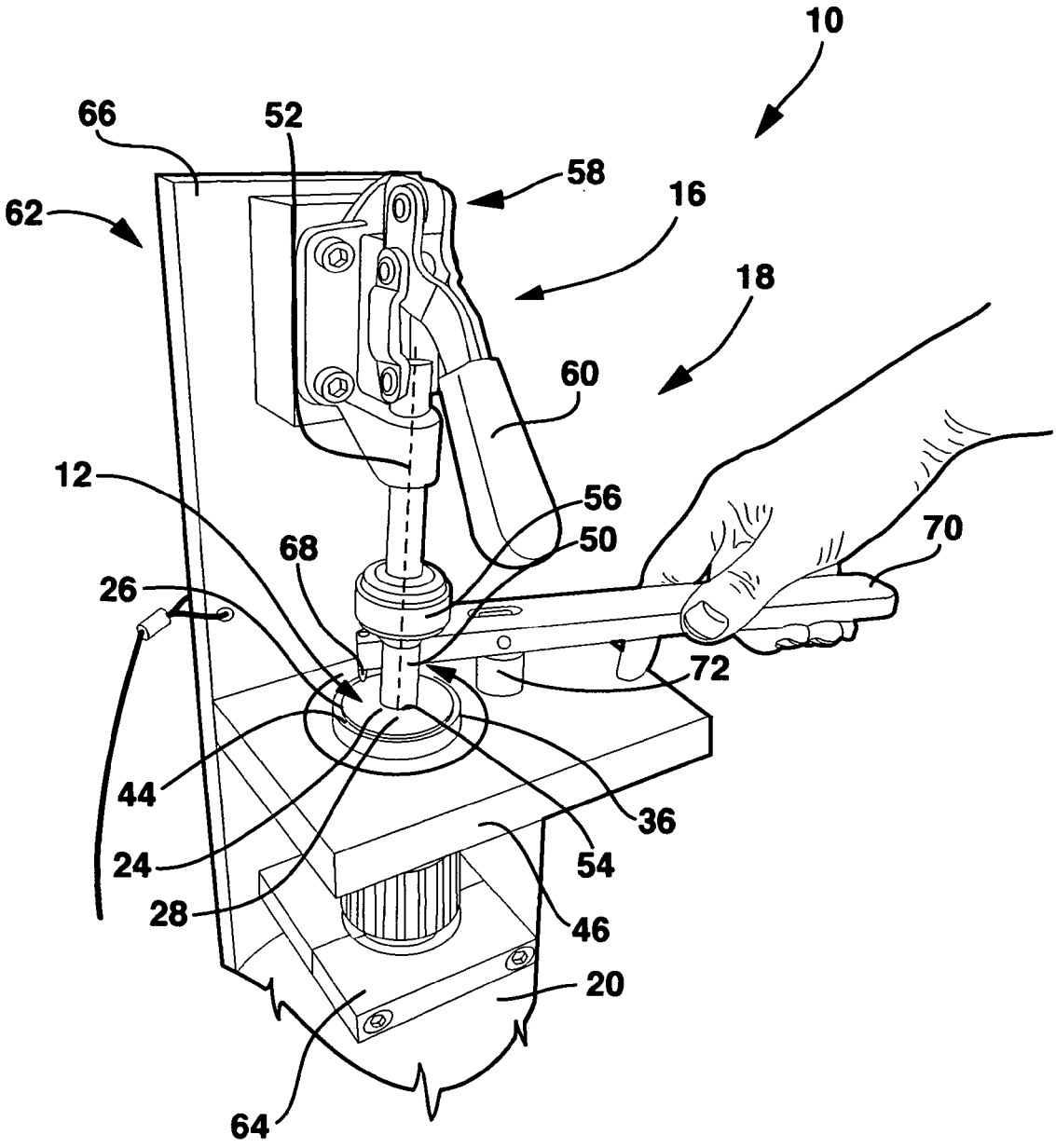
FIG. 6 is a perspective view of a flattened bottle cap that has been flattened by the invention of FIG. 1.
Figure 7:
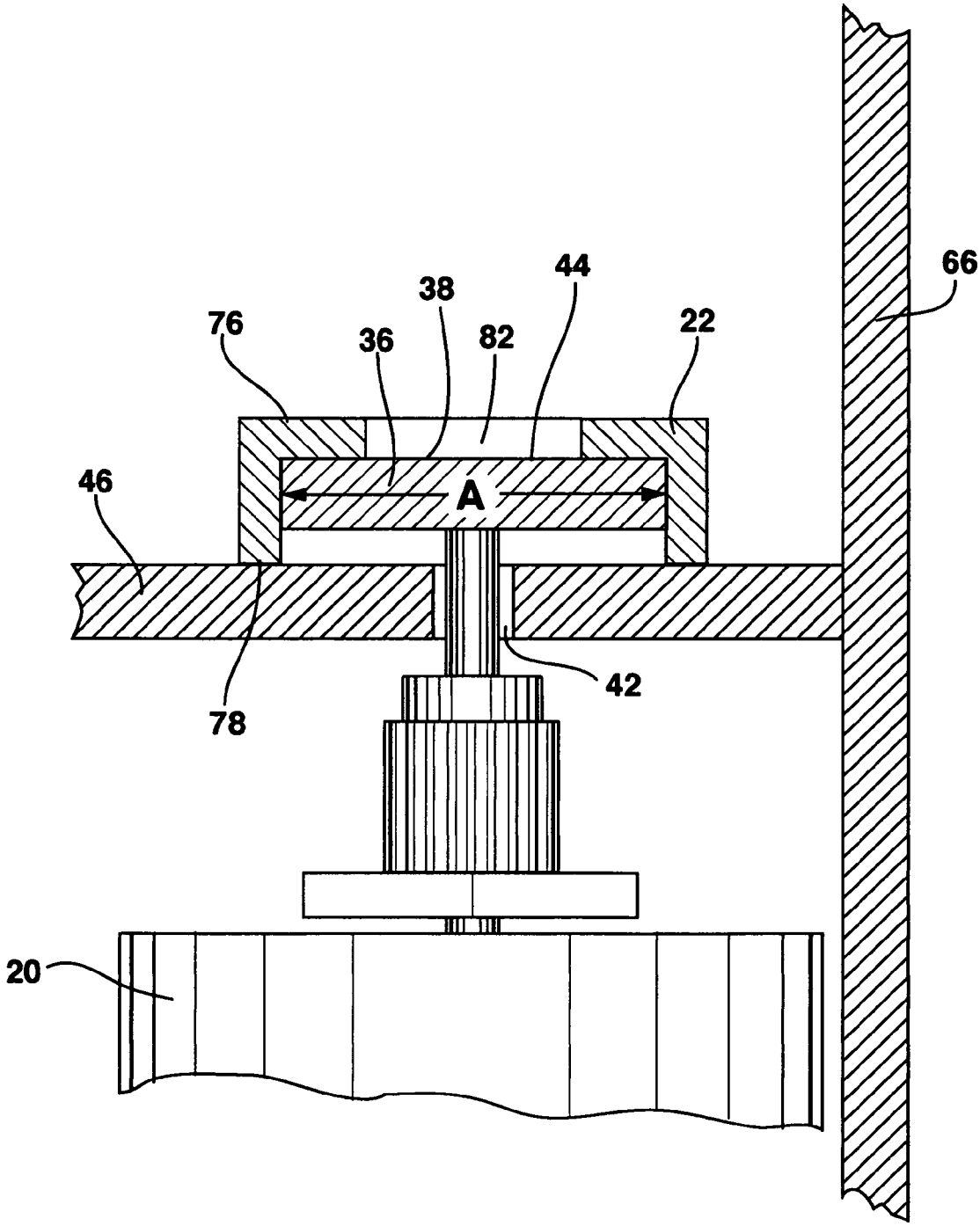
FIG. 7 is a side cross-sectional view of a portion of the invention of FIG. 1 with the positioning jig in place.

As a result, the opening 82 is sized so that a bottle cap 12 placed in the opening 82 is precisely located in the opening 82 by contact between the outer portion 32 of the bottle cap 12 and the back end 84 of the opening 82 prior to the bottle cap 12 being secured in contact with the friction surface 44 of the disk 36 by an interaction with the terminal end 54 of the pivot press 58 (FIG. 6). In particular, the back end 84 of the opening 82 is located so that when the outer portion 32 of the bottle cap 12 is positioned somewhat snuggly into contact with the back end 84, the center 34 of the bottle cap 12 is precisely located on and aligned with the axis 40 of the disk 36 when the bottle cap 12 is located on the friction surface 24 of the disk 36.

The positioning jig 22 has been described as having an opening 82 with an open end 86. However, the opening 82 may also be a hole extending from the central chamber 82 through the top side 76 and having a diameter that allows the outer portion 32 of a bottle cap 12 to just contact the edges of the hole when the central portion 24 of the bottle cap 12 comes into contact with the friction surface 24 of the disk 36. One disadvantage of this configuration of the opening 82 versus the configuration of the opening 82 having an open end 86 is that often a bottle cap 12 will have an uneven deformity in the outer portion 32 as a result of the bottle cap 12 being removed from a beverage bottle. In the embodiment having an open end 86, the bottle cap 12 may be rotated so that the deformity is oriented toward the open end 86 while the rest of the outer portion 32 of the bottle cap 12 may come into more or less uniform contact with the back end 84 of the opening 82.

The bottle cap flattener 10 of the present invention is intended to be rugged and durable and safely, comfortably and effectively flatten a bottle cap 12 as described herein. As a result, the materials of the bottle cap flattener 10 should be chosen to be strong and durable. Examples of the material used to form the support 62 and positioning member 46 include, polycarbonate plastic (e.g., LEXAN® sold by Saudi Basic Industries Corp of Saudi Arabia), ABS plastic, carbon fiber, wood including plywood, aluminum, steel and other materials as will occur to those skilled in the art.

Figure 3:
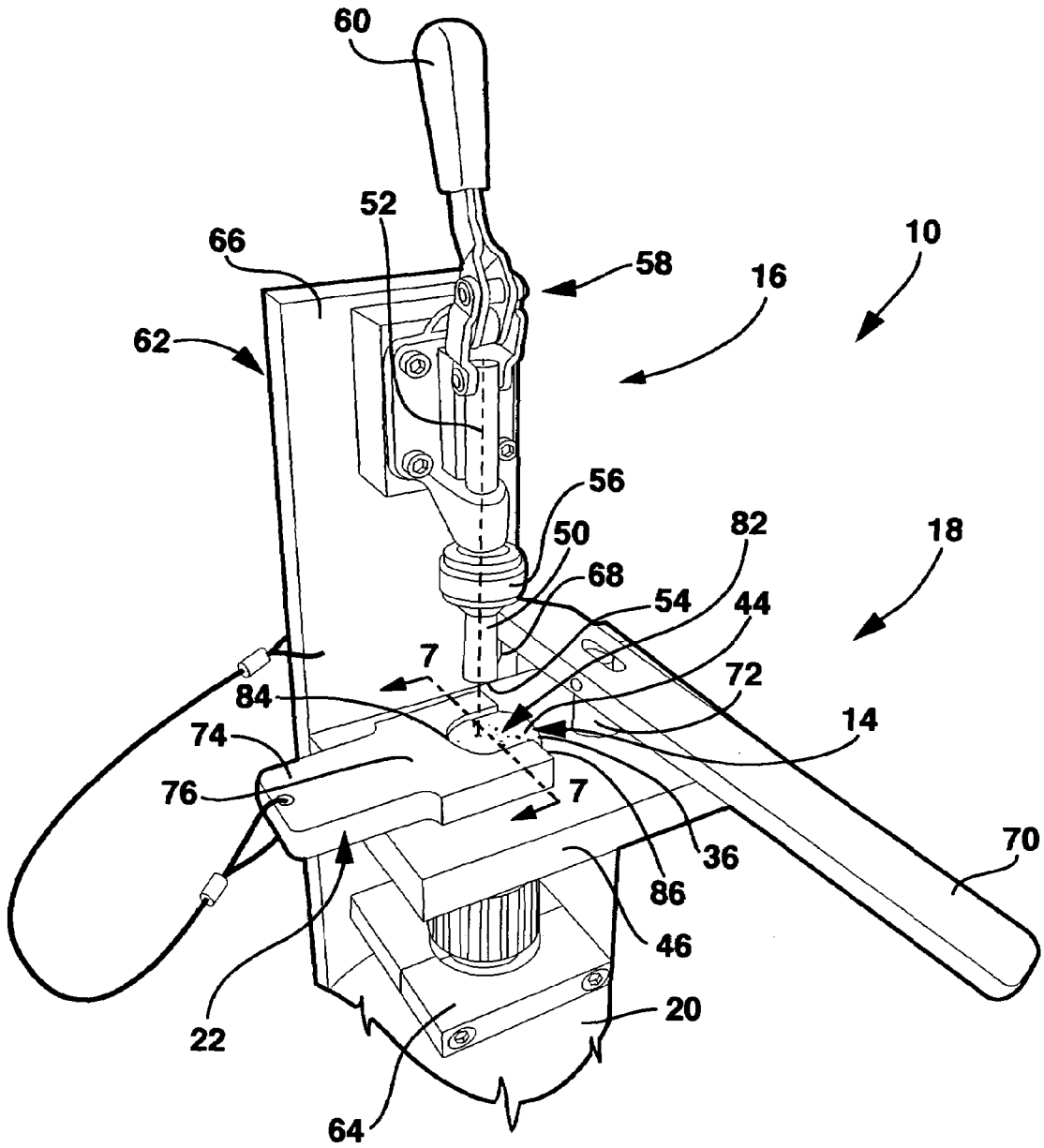
FIG. 3 is a perspective view of the bottle cap positioning jig in place on the embodiment of the invention of FIG. 1.
Figure 4:
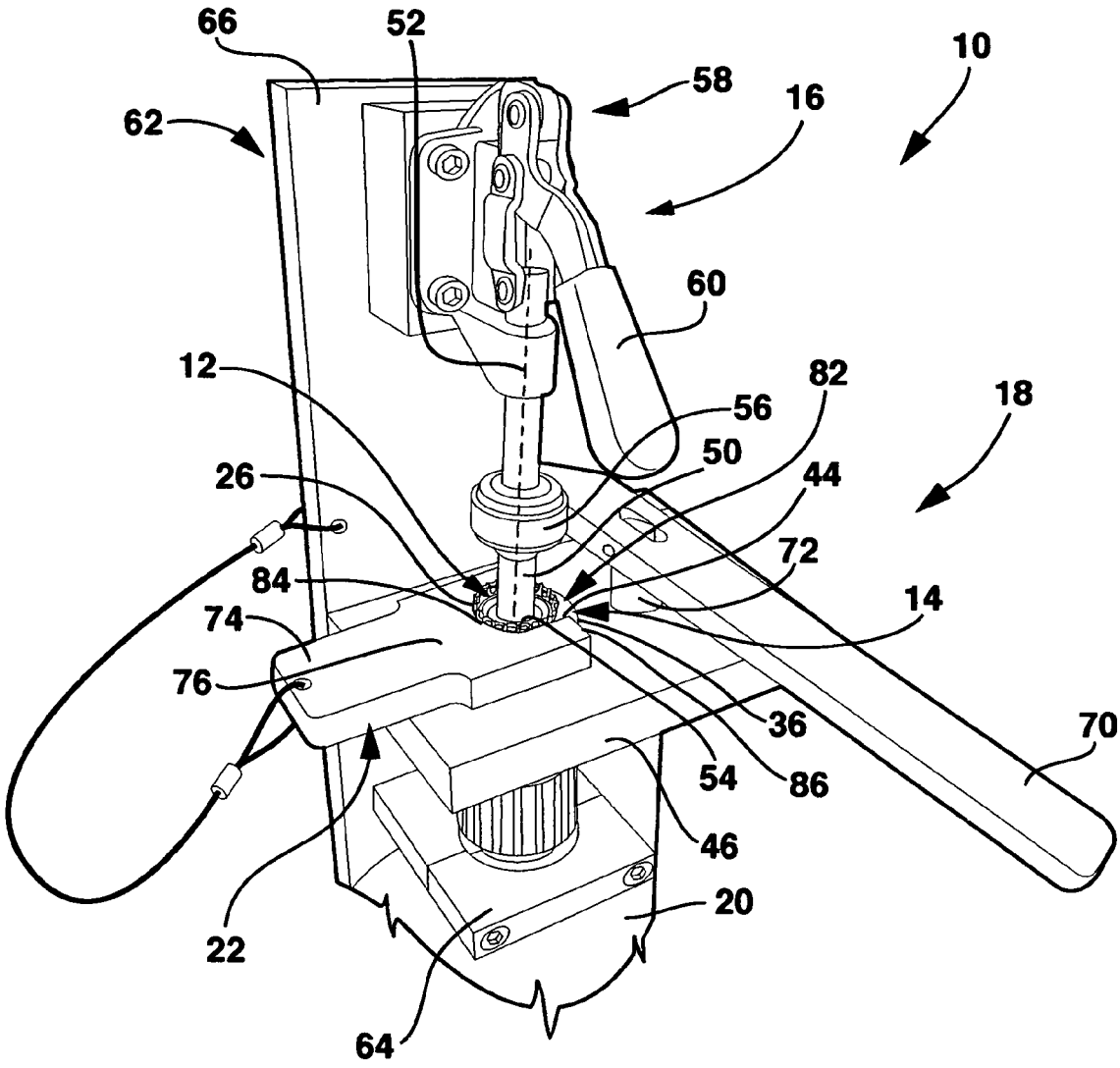
FIG. 4 is a perspective view of a bottle cap located on the disk by the bottle cap positioning jig of FIG. 3.

In use, the positioning jig 22 is slid over the disk 36 so that the central chamber 80 encases the disk 36 and the opening 82 is located over the disk 36 (FIG. 3). Thereafter, a bottle cap 12 is placed on the disk 36 in the opening 82 and the terminal end 54 is moved by the pivot press 58 into contact with the upper surface 38 of the bottle cap 12 to securely hold the bottle cap 12 on the friction surface 44 of the disk 36 (FIG. 4). Thereafter, the positioning jig 22 is removed. The motor 20 is activated through the switch 48 so that the motor 20 causes the disk 36 to rotate about its axis 40.

Figure 5:
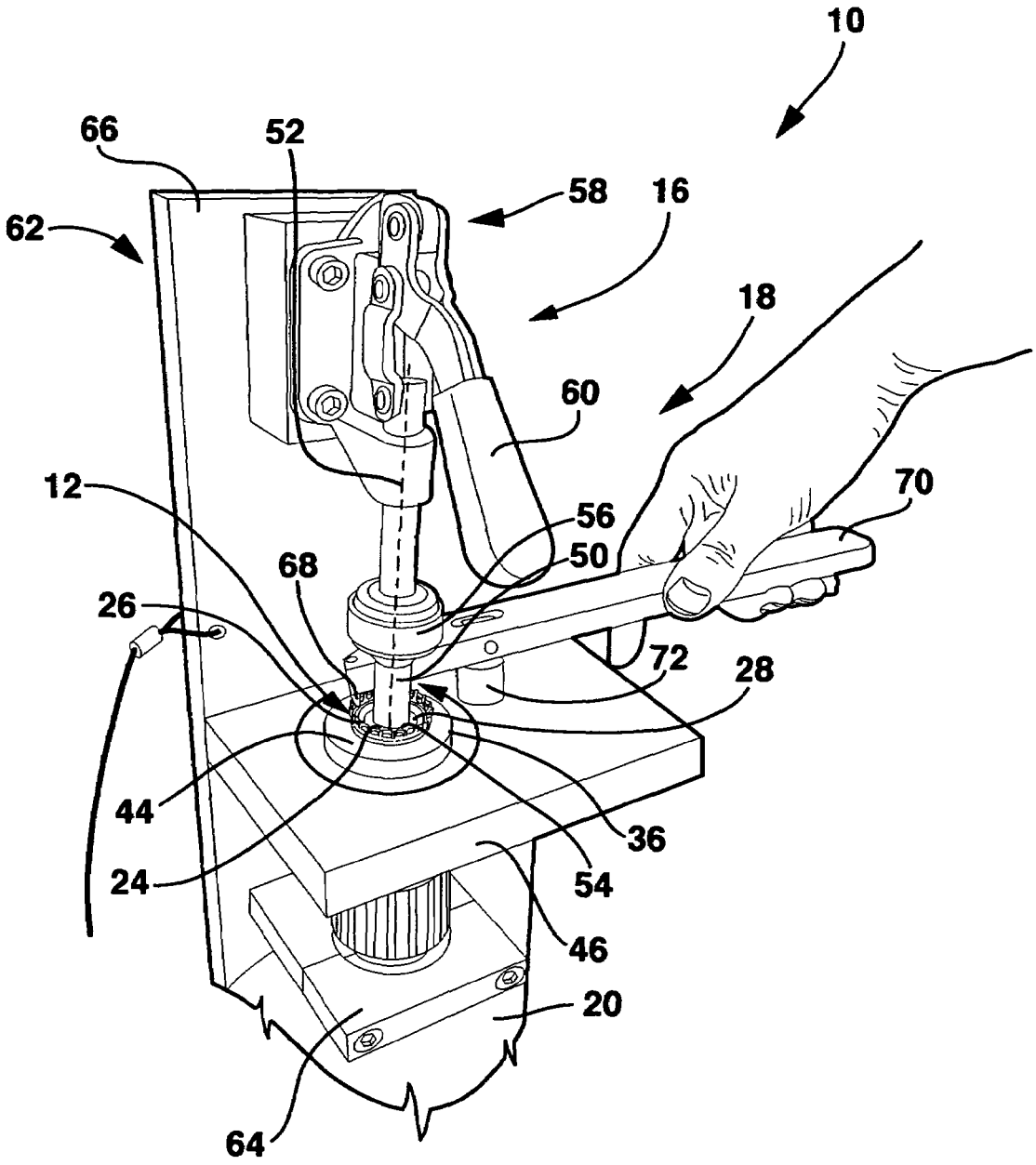
FIG. 5 is a perspective view of a bottle cap being flattened by the invention of FIG. 1.

The user then grasps the handle 70 of the bottle cap flattening tool 18 and moves the tip 68 into contact with the outer portion 32 of the bottle cap 12 (FIG. 5). This contact between the tip 68 and the outer portion 32 may occur between the pin 50 and the upper portion 66 so that as the handle 70 is pulled toward the user, the tip 68 moves radially outward from the center 34 of the bottle cap 12 toward the peripheral edge 26. Alternately, this contact between the tip 68 and the outer portion 32 may occur between the pin 50 on the side of the pin 50 opposite the upper portion 66 so that as the handle 70 is pushed away from the user, the tip 68 moves radially outward from the center 24 of the bottle cap 12 toward the peripheral edge 26.

The user contacts the inner surface 28 of the outer portion 32 with the tip 68 and then applies gentle downward pressure on the tip 68 to push the outer portion 32 toward the disk 36. It has been found that it is typically preferable to move the tip 68 to initially contact the outer portion 32 near the shoulder 30 and then move the tip 68 outward along a radial from the center 34 toward the peripheral edge 26. Alternately, the tip 68 may be moved to initially contact the outer portion 32 near the peripheral edge 26 and be moved inward along a radial from the center 34 toward the peripheral edge 26. But, variations in the bottle caps 12 themselves, in the crenellations of the outer portion 32 and dents, dings or other deformities in portions of the outer portion 32 due to the bottle cap 12 being removed from a beverage bottle may make it better to initially contact the bottle cap 12 with the tip 68 at locations other than near the peripheral edge 26. As a result, the tip 68 may be moved to initially contact the outer portion 32 between the shoulder 30 and the peripheral edge 26 and be moved either inward or outward along a radial from the center 34 toward the peripheral edge 26 as the user desires. Further, the tip 68 may be brought into contact with the central portion 24, either before or after contacting the outer portion 32, to flatten the central portion 24 where the central portion 24 is either inherently not flat or has bends, wrinkles, dents or other deformities as a result of being removed from the bottle or for any other reason.

The downward pressure applied by the tip 68 to the outer portion 32 flattens the outer portion 32 and also removes the crenellations and any dents or dings in the outer portion 32. The user may move the tip 68 across the inner surface 28 particularly across the outer portion 32 from the shoulder 30 to the peripheral edge 26 to work the outer portion 32 into a flattened configuration (FIG. 6). The user may also move the tip 68 across the central portion 24 and shoulder 30 as well as across the outer portion 32.

When the bottle cap 12 is sufficiently flattened, the user removes the tip 68 from contact with the bottle cap 12 and stops the motor 20 through the switch 48. As a result, the disk 36 will cease spinning. The user then moves the terminal end 54 of the pin 50 out of contact with the inner surface 28 of the bottle cap 12. When the terminal end 54 is out of contact with the inner surface 28 of the bottle cap 12, the flattened bottle cap 12 may be removed from contact with the disk 36 so that the flattened bottle cap 12 may be used to create new and interesting ornaments such as beads, buttons, brooches, hanging ornament, baubles, pennants, knickknacks, curios, novelty items, ornaments, trinkets, figurines, objet d'art, souvenirs or other small objects displayed for their attractiveness or interest.

The bottle cap flattener 10 of the present invention has been described as having a support 62 that rests on a bench or table. However, in another embodiment of the bottle cap flattener 10, the support 62 of the bottle cap flattener 10 may be connected directly to the bench, table, wall, partitions or similar structure that will securely position and support the bottle cap flattener 10 or the support 62 may itself be a bench, table, wall, partitions or similar structure that will securely position and support the bottle cap flattener 10. Alternately, the bottle cap flattener 10 may have other configurations for locating and supporting the positioning member 46 or pivot press 48 other than a support 62 as will occur to those skilled in the art.

The bottle cap flattener 10 of the present invention has been described as having, in a preferred embodiment, a bottle cap positioner 14, a bottle cap holder 16, a bottle cap flattening tool 18, a motor 20 and a positioning jig 22. However, not all of these elements need be present. For example, it is not essential that a positioning jig 22 be present. Where the positioning jig 22 is not present, the user may manually place a bottle cap 12 on the disk 36. Further, the bottle cap holder 16 is not required to be used or if it is used, be such that pressure is applied to a bottle cap 12 to hold the bottle cap 12 on the bottle cap positioner 14. Instead, a bottle cap 12 can be retained on the bottle cap positioner 14 by other means or methods including, but not limited to, adhesives, suction, magnetic attraction or jets of air or liquid, to name a few that will occur to those skilled in the art.

The present invention also includes several methods of flattening a bottle cap 12. In its simplest form, a method for flattening a bottle cap comprises the steps of:

rotating a bottle cap 12 having an outer portion 32, a central portion 24, a center 34 and an axis A extending through the center 34 around the axis A;

applying pressure to the outer portion 32 as the bottle cap 12 rotates to move the outer portion 32 into a flattened configuration.

This method may also include the step of applying pressure to the central portion 24 as the bottle cap 12 rotates to move the central portion 24 into a flattened configuration.

In another form, a method for flattening a bottle cap comprises the steps of:

providing a bottle cap flattener for flattening a bottle cap 12 having an outer portion 32, a central portion 24, a center 34, a peripheral edge 26 and an axis A extending through the center 34, the bottle cap flattener comprising:

a bottle cap flattening tool having a tip 68 capable of contacting a bottle cap 12, the bottle cap flattening tool for applying pressure to the bottle cap 12 through the tip 68 to force the outer portion 32 of the bottle cap 32 into a flattened configuration concurrent with the central portion 24 of the bottle cap 12; and a rotatable bottle cap positioner 14 for precisely locating a bottle cap 12 during interaction with the tip 68 so that the tip 68 can precisely interact with the bottle cap 12 to flatten the bottle cap 12 and for allowing the bottle cap 12 to rotate during interaction between the tip 68 and the bottle cap 12;

placing a bottle cap 12 on the bottle cap positioner 14;

rotating the bottle cap positioner 14 so that the bottle cap 12 rotates around the axis A;

moving the tip 68 into contact with the outer portion 32 of the bottle cap 12 as the bottle cap 12 rotates on the bottle cap positioner 14 so that the interaction between the tip 68 and the outer portion 32 gradually flattens the outer portion 32 so as not to tear or unevenly deform the material of the outer portion 32.

In another form, a method of flattening a bottle cap comprises the steps of:

providing a bottle cap flattener for flattening a bottle cap 12 having an outer portion 32, a central portion 24, a center 34, a peripheral edge 26 and an axis A extending through the center 34, the bottle cap flattener comprising:

a bottle cap flattening tool having a tip 68 capable of contacting a bottle cap 12, the bottle cap flattening tool for applying pressure to the bottle cap 12 through the tip 68 to force the outer portion 32 of the bottle cap 12 into a flattened configuration concurrent with the central portion 24 of the bottle cap 12;

a bottle cap positioner 14 for precisely locating a bottle cap 12 during interaction with the tip 68 so that the tip 68 can precisely interact with the bottle cap 12 to flatten the bottle cap 12 and for allowing the bottle cap 12 to rotate around the axis A during interaction between the tip 68 and the bottle cap 12, the rotatable bottle cap positioner 14 having a rotating disk 36;

a positioning jig 22 having a handle 74 for manipulating and placing the positioning jig 22 on the disk 36, a top side 76, a bottom side 78, a central chamber 80 extending upward from the bottom side 78 toward the top side 76 and having a width that is about equal to the diameter of the disk 36 so that the central chamber 80 may slide over the disk 36 and an opening 82 extending upward from the central chamber 80 through the top side 76;

sliding the positioning jig 22 over the disk 36 so that the central chamber 80 encases the disk 36 and the opening 82 is located over the disk 36;

placing a bottle cap 12 on the bottle cap positioner 14;

rotating the bottle cap positioner 14 so that the bottle cap 12 rotates around the axis A;

moving the tip 68 into contact with the outer portion 32 of the bottle cap 12 as the bottle cap 12 rotates on the disk 36 so that the interaction between the tip 68 and the outer portion 32 gradually flattens the outer portion 32 so as not to tear or unevenly deform the material of the outer portion 32.

Other additions to or modifications to the disclosed methods will occur to those skilled in the art.

Bottle caps 12 typically contain a seal located on the inner surface 28 that forms an airtight seal with the top of the beverage container when the bottle cap 12 is in place on the beverage container. The seal may take the form of natural cork, artificial cork or plastic and may be in the form of a disk or an annular washer. It is not necessary to remove the seal before engaging in the flattening process described above. The interaction between the tip 68 and the inner surface 28, particularly the inner surface 28 of the central portion 24, effectively also removes the seal.

Although it is preferable to not remove the seal from the bottle cap 12 before flattening the bottle cap 12 according to the method of the present invention, for some users and under some circumstances it may be desirable to remove the seal before flattening the bottle cap 12 as described above. When it is desired to remove the seal, it may be desirable to prepare the seal to make it easier to remove. This is preferably accomplished by placing the bottle cap 12 in a vat of boiling water to soften the seal and to clean the bottle cap 12. Whether the seal is prepared for removal by softening or not, the removal of the seal from the bottle cap 12 may be accomplished by abrading the seal with an abrasion tool having an abrasive surface or by hooking the seal with an instrument having a curved end and then pulling the seal away from the inner surface to separate the seal from the bottle cap 12. Alternately, the seal may be grasped by a pair of pliers and then pulled to separate the seal from the bottle cap 12. After the seal has been removed from the bottle cap 12, the bottle cap 12 may again, but is not required to be placed in a vat of boiling water to remove any remaining residue of the seal.

In view the foregoing, a bottle cap flattener 10 and method is described that flattens a bottle cap 12. The bottle cap flattener 10 has been described in connection with several embodiments, configurations and relative dimensions. However, the description above is not to be construed as being limited to the particular disclosed embodiments. It is to be understood that the description given herein has been given for the purpose of explaining and illustrating the invention and is not intended to limit the scope of the invention. For example, the specific form, size and material of the bottle cap positioner 14, bottle cap holder 16, bottle cap flattening tool 18, motor 20 or positioning jig 22 may be varied according to the desire of the user. Further, other means for locating the tip 68 with respect to the bottle cap 12 may be used so long as the function of applying the tip 68 to a desired portion of the bottle cap 12 as described herein is accomplished.

In addition, because bottle caps 12 are typically discarded after opening the beverage containing bottles that the bottle caps 12 seal, using bottle caps 12 to make ornamental objects such as jewelry recycles the bottle caps 12 and thereby reduces waste. As a result, the bottle cap flattener 10 helps in being environmentally responsible by reducing waste.

The disk 36 has also been described as being oriented so that the upper surface 38 is facing upward. However, the disk 36 may be oriented in any other manner so long as a bottle cap 12 may be brought into contact with and secured in contact with the disk 36 by the pivot press 58 or other linear actuator or other means. Changes in orientation of the disk 36 may also require corresponding changes in the orientation of other components of the bottle cap flattener 10 including the bottle cap holder 16, bottle cap flattening tool 18 or motor 20 as will be clear to those skilled in the art.

The bottle cap positioner 14 has been described in a preferred embodiment as having a rotating disk 36 that, when in contact with a bottle cap 12, causes the bottle cap 12 to rotate so that the tip 68 contacts various parts of the outer portion 32 of the bottle cap 12 as the bottle cap 12 rotates on the disk 36. This interaction between the tip 68 and the outer portion 32 allows the outer portion 32 to be gradually flattened so as not to tear or unevenly deform the material of the outer portion 32. Although it is preferred for the bottle cap 12 to rotate and for the tip 68 to remain essentially motionless (except for moving more or less radially from the center 34 of the bottle cap to the peripheral edge 26), it is within the scope of the bottle cap flattener 10 that the bottle cap 12 remain motionless and the tip 68 move around the outer portion 32 to gradually and sequentially flatten the outer portion 32. In this embodiment of the bottle cap flattener 10, the bottle cap flattening tool 18, including the tip 68, is mounted on a ring so that the tip 68 moves around the ring as the tip 68 moves into and stays in contact with the outer portion 32.

In addition, it is clear than an almost infinite number of minor variations to the form and function of the disclosed inventions could be made and also still be within the scope of the invention. Consequently, it is not intended that the inventions be limited to the specific embodiments and variants of the inventions disclosed. It is to be further understood that changes and modifications to the descriptions given herein will occur to those skilled in the art. Therefore, the scope of the inventions should be limited only by the scope of the claims.

I claim:

1. A bottle cap flattener for flattening a bottle cap having an outer portion, a central portion, a center and a peripheral edge, the bottle cap flattener comprising:

a bottle cap flattening tool having a tip capable of contacting a bottle cap, the bottle cap flattening tool for applying pressure to the bottle cap through the tip to force the outer portion of the bottle cap into a flattened configuration concurrent with the central portion of the bottle cap; and a bottle cap positioner for precisely locating a bottle cap during interaction with the tip so that the tip can precisely interact with the bottle cap to flatten the bottle cap.

2. The bottle cap flattener of claim 1 further comprising a bottle cap holder that applies force to a bottle cap located on the bottle cap positioner to hold the bottle cap in a precise relationship with the bottle cap positioner.

3. The bottle cap flattener of claim 2 wherein the bottle cap holder comprises:

an elongated pin having a pin axis and a terminal end wherein the pin moves longitudinally along its pin axis so that the terminal end moves into and out of contact with an inner surface of a bottle cap placed on the bottle cap positioner;

a pivot press that applies force to the pin to move the pin longitudinally along the pin axis.

4. The bottle cap flattener of claim 3 further comprising a positioning bearing that allows the pin to move only longitudinally through the positioning bearing.

5. The bottle cap flattener of claim 3 wherein the pivot press is a linear actuator.

6. The bottle cap flattener of claim 3 wherein the terminal end is roughly semi-circular so that only a portion of the cross-section of the pin actually contacts a bottle cap on the bottle cap positioner.

7. The bottle cap flattener of claim 1 wherein the bottle cap positioner includes a rotatable disk having an upper surface and an axis wherein the disk is able to spin around its axis.

8. The bottle cap flattener of claim 7 wherein the disk has a diameter slightly larger than the diameter of a bottle cap after it is flattened.

9. The bottle cap flattener of claim 7 wherein the disk is oriented so that the upper surface faces upwards.

10. The bottle cap flattener of claim 7 wherein the disk has a friction surface that holds the bottle cap on a desired location on the disk.

11. The bottle cap flattener of claim 10 wherein the friction surface is chosen from the group consisting of a disk of rubberized material attached to the disk, material applied to the disk in liquefied form that hardens into a friction surface, the disk being made of a material that inherently has a high friction surface or the disk being modified by scratching, etching or molding to form a high friction surface.

12. The bottle cap flattener of claim 7 further comprising a positioning member that locates and supports the disk.

13. The bottle cap flattener of claim 12 further comprising a bearing that attaches the disk to the positioning member which bearing that allows the disk to freely rotate around the axis of the disk.

14. The bottle cap flattener of claim 7 further comprising a motor attached to the disk so that the motor causes the disk to rotate around the axis of the disk.

15. The bottle cap flattener of claim 14 further comprising a switch to control the motor.

16. The bottle cap flattener of claim 7 further comprising a positioning jig to precisely locate the bottle cap on the bottle cap positioner before the interaction of the tip and the bottle cap takes place.

17. The bottle cap flattener of claim 16 wherein the positioning jig includes a handle, a top side, a bottom side and a central chamber extending upward from the bottom side toward the top side wherein the central chamber has a width that is about equal to the diameter of the disk so that the central chamber may slide over the disk and an opening that extends upward from the central chamber through the top side.

18. The bottle cap flattener of claim 17 wherein the opening on the positioning jig has a curved back end and an open end and wherein the back end has a curvature approximately equal to curvature of the peripheral edge of the outer portion of a bottle cap and the opening has a width about equal to the diameter of an outer portion of a typical bottle cap that has been removed from a beverage bottle.

19. The bottle cap flattener of claim 1 wherein the bottle cap flattening tool further comprises a handle that imparts movement to the tip into and out of contact with the bottle cap on the bottle cap positioner from a location at the center of the bottle cap to the peripheral edge of the bottle cap.

20. The bottle cap flattener of claim 19 wherein the bottle cap flattening tool is an elongated member having a first end and wherein the tip is located near the first end.

21. The bottle cap flattener of claim 20 wherein the bottle cap flattening tool is manually controlled.

22. The bottle cap flattener of claim 20 wherein the bottle cap flattening tool is controlled by a control system.

23. The bottle cap flattener of claim 1 wherein the bottle cap holder comprises:

an elongated pin having a pin axis and a terminal end wherein the pin moves longitudinally along its pin axis so that the terminal end moves into and out of contact with an inner surface of a bottle cap placed on the bottle cap positioner;

a pivot press that applies force to the pin to move the pin longitudinally along the pin axis;

wherein the bottle cap positioner includes a rotatable disk having an upper surface and an axis wherein the disk is able to spin around its axis and a positioning member that locates and supports the disk;

further comprising a support to which the pivot press and positioning member are attached.

24. The bottle cap flattener of claim 23 wherein the support is a single elongated L-shaped piece having a bottom portion and an upper portion wherein the bottom portion rests on a bench or table and the upper portion supports the pivot press and positioning member.

25. A bottle cap flattener for flattening a bottle cap having an outer portion, a central portion, a center and a peripheral edge, the bottle cap flattener comprising:

a bottle cap flattening tool having a tip capable of contacting a bottle cap, the bottle cap flattening tool for applying pressure to the bottle cap through the tip to force the outer portion of the bottle cap into a flattened configuration concurrent with the central portion of the bottle cap wherein the bottle cap flattening tool further comprises a handle that imparts movement to the tip;

a bottle cap positioner for precisely locating a bottle cap during interaction with the tip so that the tip can precisely interact with the bottle cap to flatten the bottle cap wherein the bottle cap positioner includes a rotatable disk having an upper surface and an axis wherein the disk is able to spin around its axis; and;

a bottle cap holder that applies force to a bottle cap located on the bottle cap positioner to hold the bottle cap in a precise relationship with the bottle cap positioner;

wherein the handle moves the tip into and out of contact with the bottle cap on the bottle cap positioner from a location at the center of the bottle cap to the peripheral edge of the bottle cap.

26. A method of flattening a bottle cap having an outer portion, a central portion, a center and an axis extending through the center, the method comprising the steps of:

rotating the bottle cap about the axis;

applying pressure to the outer portion as the bottle cap rotates to move the outer portion into a flattened configuration.

27. The method of claim 26 further comprising the step of applying pressure to the central portion as the bottle cap rotates to move the central portion into a flattened configuration.

* * * * *